US008113112B2

(12) United States Patent
Tong

(10) Patent No.: US 8,113,112 B2
(45) Date of Patent: Feb. 14, 2012

(54) FOOT SENSOR RUBBISH BIN

(76) Inventor: Li-Fang Tong, Shalu Township, Taichung County (TW)

( * ) Notice: Subject to any disclaimer, the term of this patent is extended or adjusted under 35 U.S.C. 154(b) by 435 days.

(21) Appl. No.: 12/479,706

(22) Filed: Jun. 5, 2009

(65) Prior Publication Data

US 2010/0308045 A1 Dec. 9, 2010

(51) Int. Cl.
*B30B 9/30* (2006.01)

(52) U.S. Cl. ..... 100/48; 100/99; 100/345

(58) Field of Classification Search ..... 318/466–468
See application file for complete search history.

(56) References Cited

U.S. PATENT DOCUMENTS

| | | | | |
|---|---|---|---|---|
| 7,146,785 | B2 * | 12/2006 | Stravitz | 53/567 |
| 7,481,159 | B2 * | 1/2009 | Poss et al. | 100/48 |
| 7,895,683 | B2 * | 3/2011 | Sawalski et al. | 4/223 |
| 7,958,704 | B2 * | 6/2011 | Stravitz et al. | 53/567 |

* cited by examiner

*Primary Examiner* — Mark Budd
(74) *Attorney, Agent, or Firm* — Alan Kamrath; Kamrath IP Lawfirm, PA

(57) ABSTRACT

A foot sensor rubbish bin is controlled to open and close by extending the user's foot into a recess of a base to actuate a sensor without using the user's hands, which provides the user with much convenience. Moreover, since the sensor is disposed at the recess of the base, the unnecessary interference can be avoided, thus reducing the energy waste and complying with the requirements of environmental protection.

11 Claims, 8 Drawing Sheets

FOOT SENSOR RUBBISH BIN

BACKGROUND OF THE INVENTION

1. Field of the Invention

The present invention relates to a rubbish bin, and more particularly to a foot sensor rubbish bin.

2. Description of the Prior Art

A conventional sensor rubbish bin is installed with a sensor on a lid or an outer periphery thereof, so that when the user wants to throw the rubbish into the rubbish bin, he only needs to move his hand close to the sensor, the lid of the rubbish bin will automatically open for putting of the rubbish. However, since the sensor is installed on the lid or the outer periphery of the rubbish bin, so that when a person approaches the rubbish bin but doesn't want to put the rubbish, the lid of the rubbish bin will still open, thus causing energy waste. Therefore, this conventional sensor rubbish bin doesn't comply with the requirements of environmental protection, thus needing improvements.

The present invention has arisen to mitigate and/or obviate the afore-described disadvantages.

SUMMARY OF THE INVENTION

The primary objective of the present invention is to provide a foot sensor rubbish bin which can be easily controlled to open and close without using the user's hands, thus reducing the energy waste and complying with the requirements of environmental protection.

To achieve the objective of the present invention, the foot sensor rubbish bin comprises a base connected to an outer barrel. An upper lid is pivoted to the outer barrel. A drive assembly is received in the base and comprises a power supply device electrically connected to a motor and a control circuit board. The control circuit board controls the power supply device and the motor. The drive assembly further includes a gear cluster drivingly connected to the motor. The gear cluster drives one end of a linkage push rod, and the other end of the linkage push rod extends into the outer barrel adjacent to the upper lid, characterized in that: the base is defined with a recess in an outer periphery thereof, a sensor is disposed in the recess and electrically connected to the control circuit board. The rubbish bin is controlled to open and close by extending the user's foot into the recess of the base, which provides the user with much convenience. Moreover, the position of sensor can avoid the unnecessary interference, thus reducing the energy waste and complying with the requirements of environmental protection.

DETAILED DESCRIPTION OF THE PREFERRED EMBODIMENTS

Figure 1:
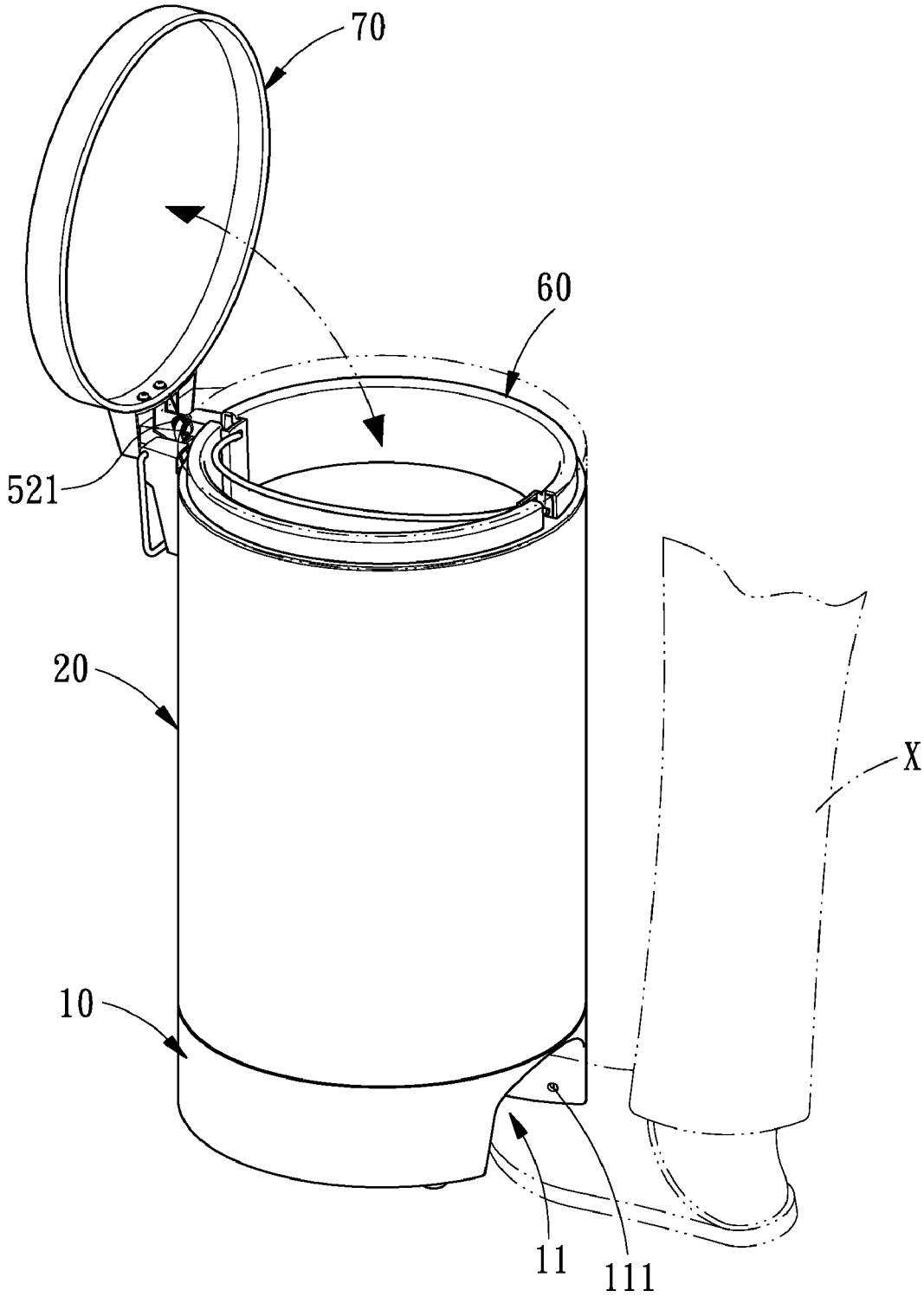
FIG. 1 is a perspective view of a foot sensor rubbish bin in accordance with the present invention.
Figure 2:
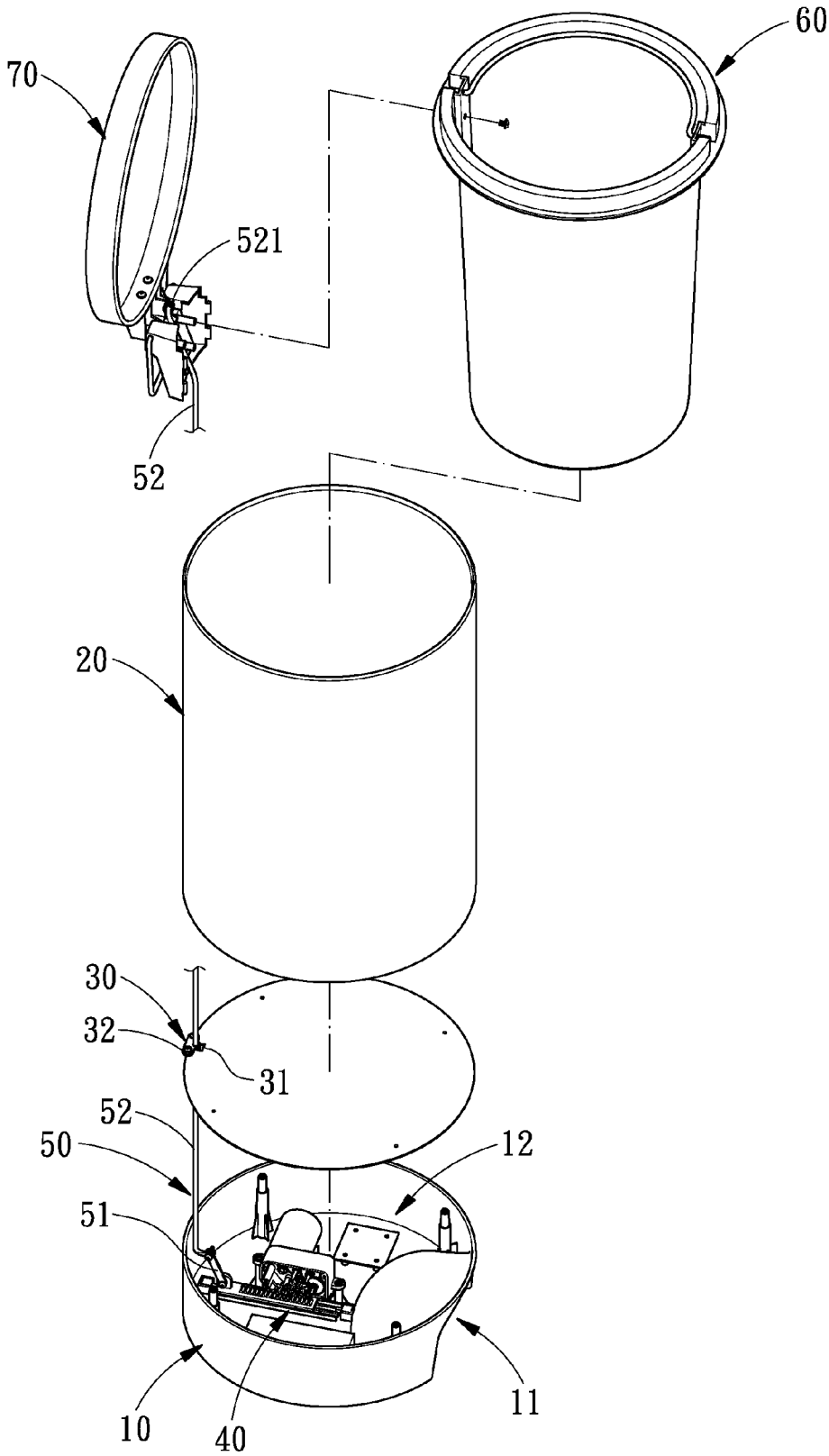
FIG. 2 is an exploded view of the foot sensor rubbish bin in accordance with the present invention.
Figure 3:
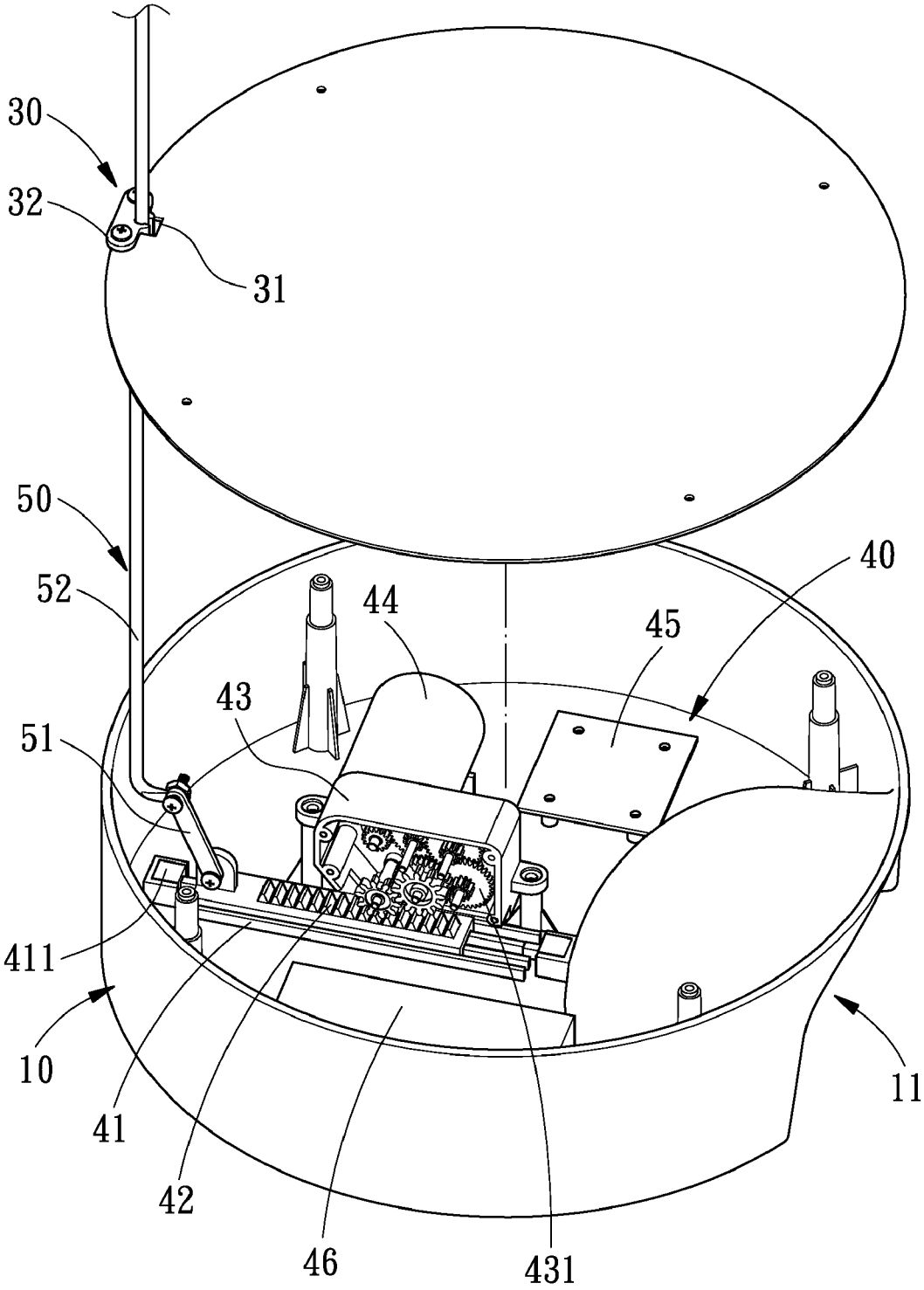
FIG. 3 is an assembly perspective view of the foot sensor rubbish bin in accordance with the present invention.
Figure 4:
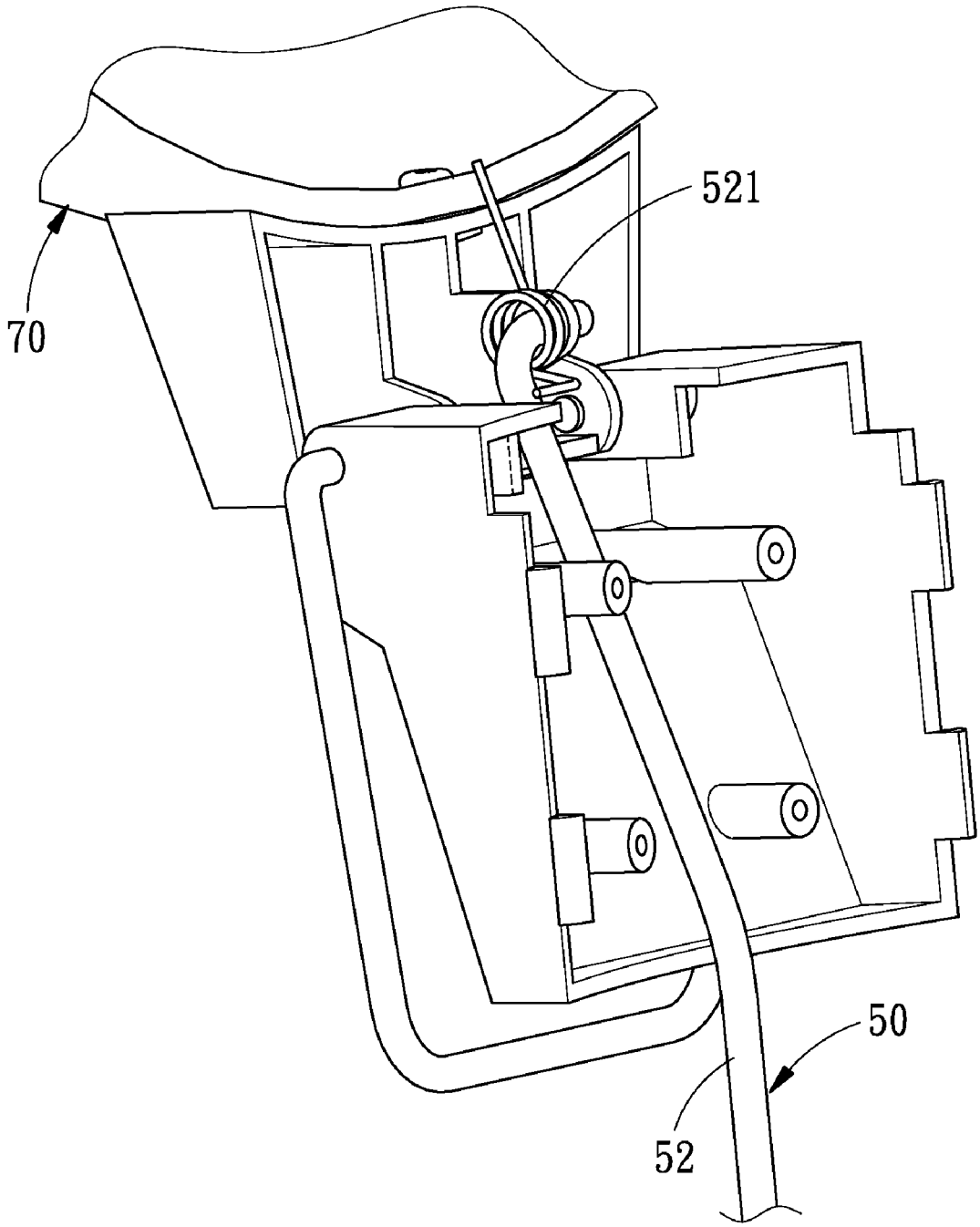
FIG. 4 is an assembly perspective view of the foot sensor rubbish bin in accordance with the present invention.

The present invention will be clearer from the following description when viewed together with the accompanying drawings, which show, for purpose of illustrations only, the preferred embodiment in accordance with the present invention.

Referring to FIGS. 1-4, a foot sensor rubbish bin in accordance with a preferred embodiment of the present invention comprises a base 10, an outer barrel 20, a partition plate 30, a drive assembly 40, a linkage push rod 50, an inner barrel 60 and an upper lid 70.

The base 10 is defined with a recess 11 in an outer periphery thereof. The recess 11 is provided with a sensor 111.

The outer barrel 20 is disposed on the base 10.

The partition plate 30 is disposed between the base 10 and the outer barrel 20 to define a chamber 12 between the base 10 and the partition plate 30. The partition plate 30 is defined with a through hole 31 and provided with a clamping member 32 adjacent to the through hole 31.

The drive assembly 40 is received in the chamber 12 of the base 10 and includes a slide rail 41, a teeth bar 42, a gear box 43, a motor 44, a control circuit board 45 and a power supply device 46. The slide rail 41 has one end located adjacent to the recess 11 and the other end located away from the recess 11. The teeth bar 42 is slidably disposed on the slide rail 41 and provided with a limit switch 411 on each of opposite ends thereof. The gear box 43 is disposed adjacent to the slide rail 41 and interiorly provided with a gear cluster 431 to be meshed with the teeth bar 42. The gear box 43 is electrically connected to the motor 44. The motor 44 drives the gears of the gear cluster 431 in such a manner that when the gears of the gear cluster 431 rotate, the teeth bar 42 will slide along the slide rail 41. The control circuit board 45 is electrically connected to the power supply device 46, and the sensor 111. The respective limit switches 411 are electrically connected to the power supply device 46. The power supply device 46 is provided for holding batteries.

The linkage push rod 50 includes a swing arm 51 and a push rod 52 pivotally connected to the swing arm 51. The swing arm 51 has one end pivoted to the teeth bar 42 of the drive assembly 40 and the other end pivoted to the push rod 52. The push rod 52 penetrates the through hole 31 of the partition plate 30 and extends into the outer barrel 20 while being clamped by the clamping member 32. The swing arm 51 of the linkage push rod 50 is driven by the teeth bar 42 to pivot. The push rod 52 is limited and guided to move up and down by the clamping member 32. The push rod 52 has a free end engaged with a push spring 521.

The inner barrel 60 is received in the outer barrel 20 in such a manner that the push rod 52 of the linkage push rod 50 is located between the outer barrel 20 and the inner barrel 60.

The upper lid 70 is pivoted to the outer barrel 20 in an openable and closable manner.

When the user X needs to put the rubbish into the rubbish bin of the present invention, as shown in FIG. 1, he will extend his foot into the recess 11 of the base 10 to actuate the sensor 111 in the recess 11 to send a signal to the control circuit board 45. When receiving the signal, the control circuit board 45 will control the power supply device 46 to supply power.

Figure 5:
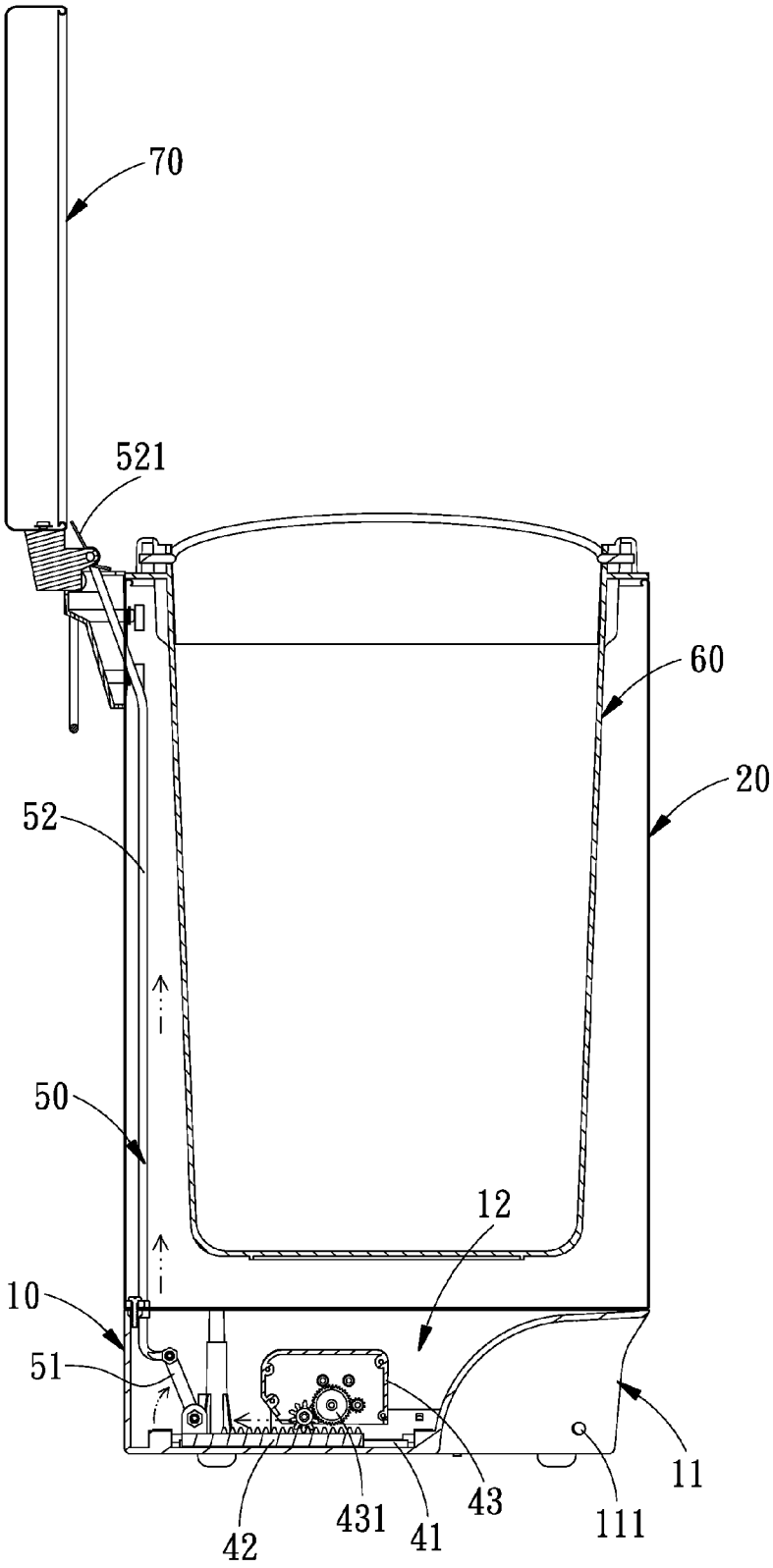
FIG. 5 is an illustrative view showing an open condition of the foot sensor rubbish bin in accordance with the present invention.

When the power supply device 46 supplies power, the motor 44 of the drive assembly 40 will drive the gear cluster 431 to make the gears of the gear cluster 431 to pivot. When the gears pivot, the teeth bar 42 meshed with the gears will be driven to slide along the slide rail 41. When the teeth bar 42 slides away from the recess 11, the linkage push rod 50 will be pushed by the teeth bar 42 to make the swing arm 51 pivot upward and the push rod 52 move upward. Since the push rod is limited by the clamping member 32, the push rod 52 is guided by the clamping member 32 to move, thus avoiding excursion and ensuring smoother movement. When the push rod 52 moves upward, the push spring 521 at the top end of the push rod 52 will push and open the upper lid 70, as shown in FIG. 5, so that the user can put the rubbish into the opened rubbish bin. When the upper lid 70 opens, and the teeth bar 42 touches the limit switch 411 of the slide rail 41, the limit switch 411 will control the power supply device 46 to stop supplying power, so that the drive assembly 40 will stop working, avoiding damage to the drive assembly 40 and energy waste due to non-stop operation of the drive assembly.

Figure 6:
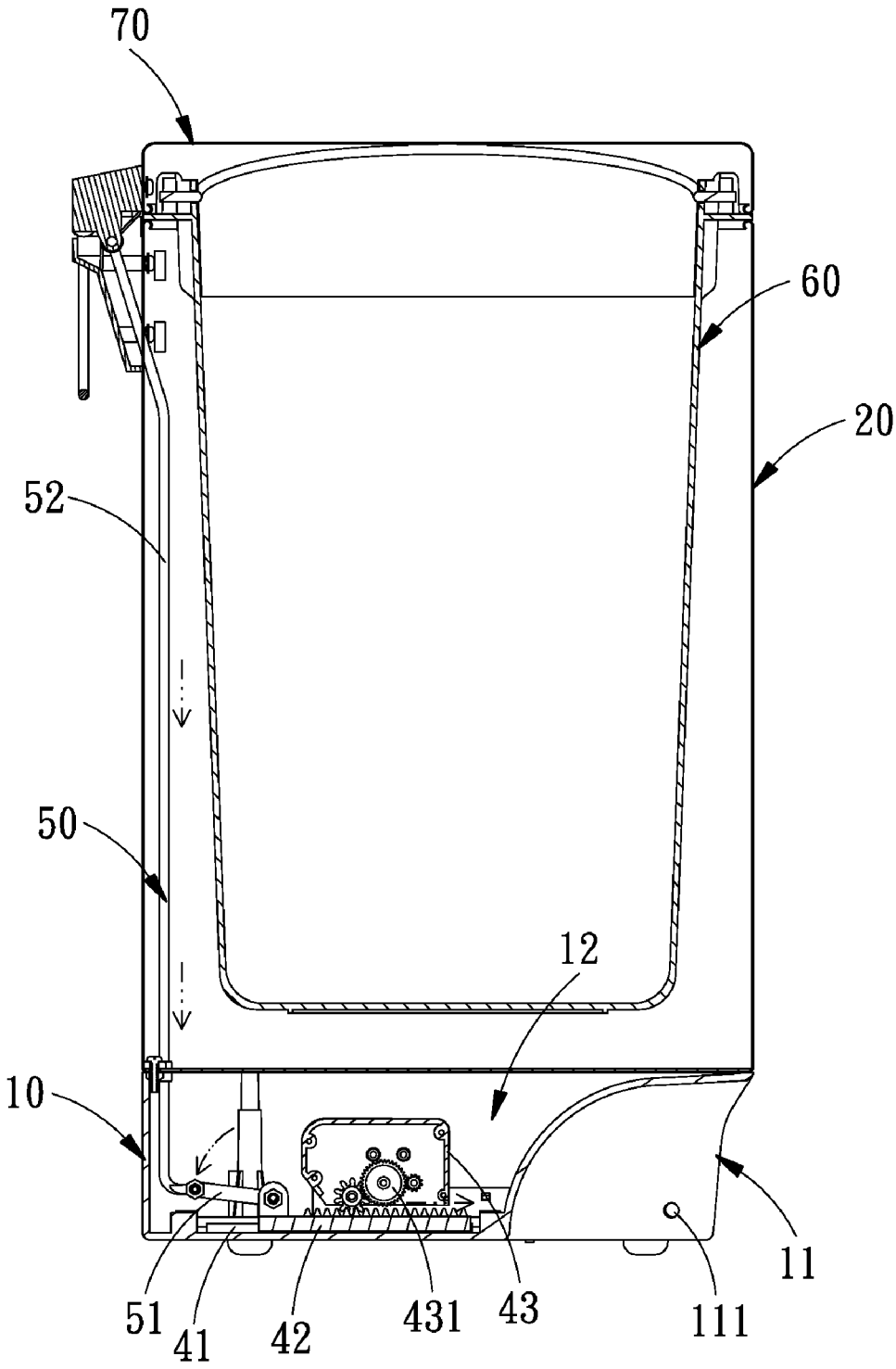
FIG. 6 is an illustrative view showing a close condition of the foot sensor rubbish bin in accordance with the present invention.

The control circuit board 45 can be set with different functions, such as the control circuit board 45 can be set in such a manner that after the teeth bar 42 touches the limit switch 411, the control circuit board 45 will start timing, when the predetermined time is due, the control circuit board 45 will control the motor 44 of the drive assembly 40 to rotate counterclockwise, when the motor 44 rotates counterclockwise, the teeth bar 42 will move toward the recess 11, when the teeth bar 42 moves toward the recess 11, the teeth bar 42 will pull the linkage push rod 50 to make the swing arm 51 of the linkage push rod 50 pivot downwards to drive the push rod 52 to move downwards, so that the push spring 521 of the push rod 52 will move away from the upper lid 70 to close the upper lid 70, as shown in FIG. 6.

Figure 7:
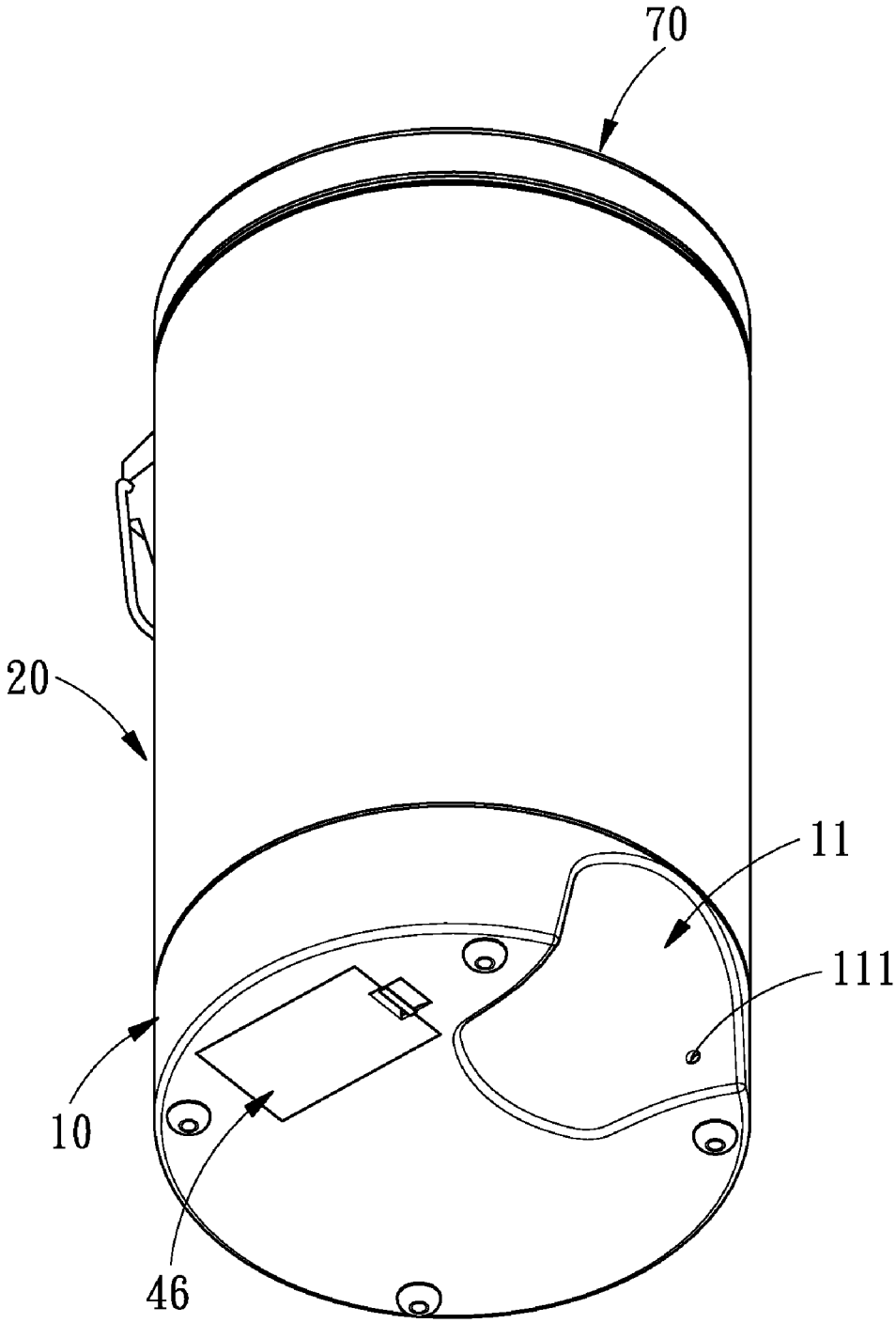
FIG. 7 is a perspective view of a bottom of the foot sensor rubbish bin in accordance with the present invention.

In addition, the control circuit board 45 can be set in such a manner that when receiving a first signal, the control circuit board 45 will control the motor 44 of the drive assembly 40 to rotate clockwise, when receiving a second signal, the control circuit board 45 will control the motor 44 of the drive assembly 40 to rotate counterclockwise, so that the rubbish bin of the present invention is controlled to open and close by the foot of the user. It can be found that the above two control methods both provide the user with much convenience. Moreover, since the user extends his foot into the recess 11 of the base 10 while using his hands to carry objects or the rubbish to be thrown, the user can both use his hands and feet, thus improving working efficiency. Since the sensor 111 is disposed at the recess 11 of the base 10, the user can not only completely control the opening of the rubbish bin, but also avoid the unnecessary interference, thus reducing the energy waste and complying with the requirements of environmental protection. Referring to FIG. 7, the power supply device 46 opens toward the bottom side of the base 10 to facilitate replacing the batteries, further improving use convenience of the rubbish bin.

Figure 8:
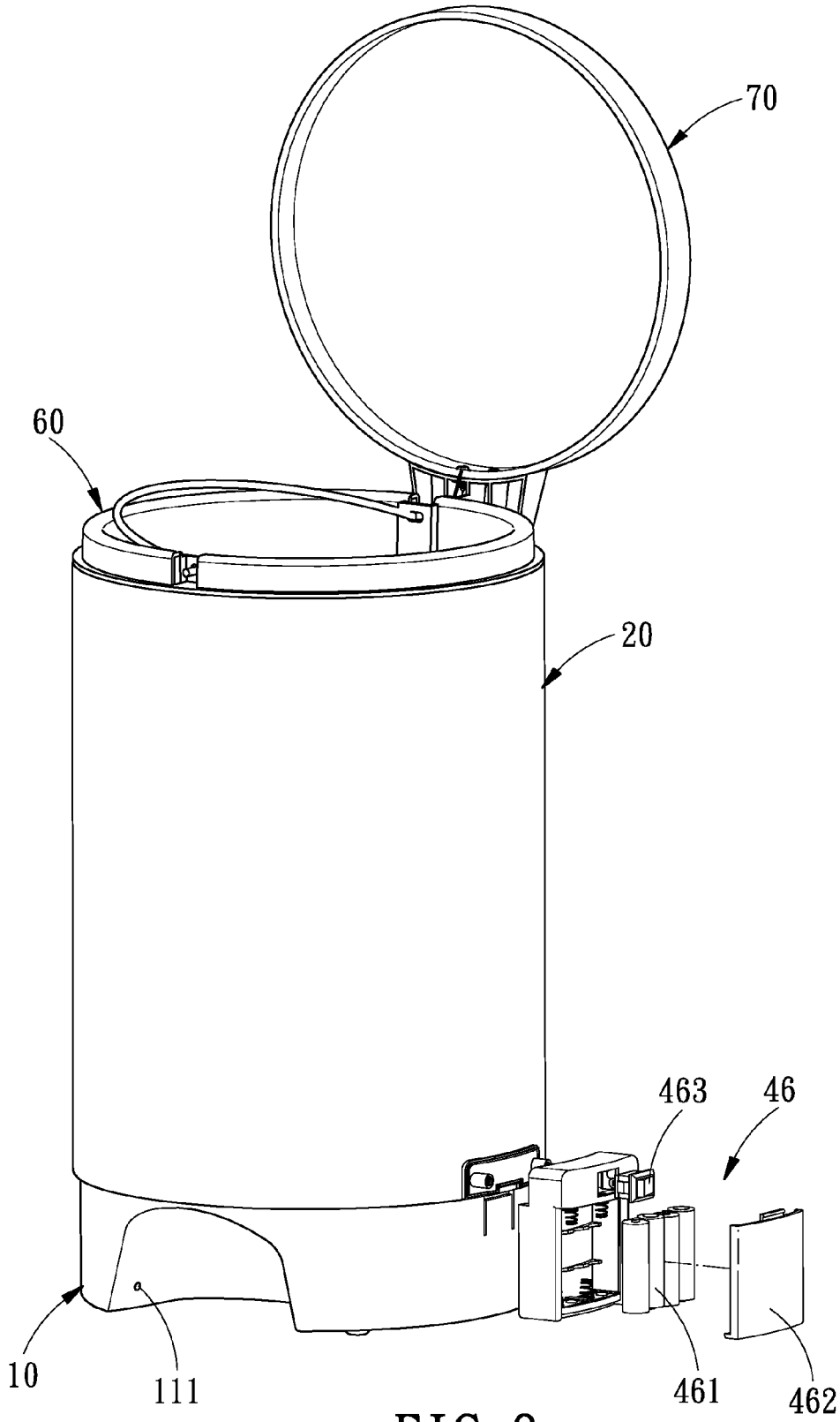
FIG. 8 is an illustrative view showing a power supply device being disposed at an outer side of a base of the foot sensor rubbish bin in accordance with the present invention.

Further referring to FIG. 8, the power supply device 46 is disposed at an outer side of the base 10 and holds a battery pack 461. The power supply device 46 is further provided with a cover 462 to be opened to replace the battery pack 461 and a power switch 463. If the rubbish bin will be out of use for a long time, the power switch 463 can be used to turn off the power supply device 46, avoiding the energy waste.

While we have shown and described various embodiments in accordance with the present invention, it is clear to those skilled in the art that further embodiments may be made without departing from the scope of the present invention.

What is claimed is:

1. A foot sensor rubbish bin comprising:

a base being connected to an outer barrel, an upper lid being pivoted to the outer barrel, the base being provided with a drive assembly including a motor and a control circuit board, the motor and the control circuit board of the drive assembly being received in the base, the base being further provided with a power supply device electrically connected to the motor and the control circuit board, the control circuit board controlling the power supply device and the motor, the drive assembly further including a gear cluster received in the base and drivingly connected to the motor, the gear cluster driving one end of a linkage push rod, the other end of the linkage push rod extending into the outer barrel adjacent to the upper lid, characterized in that:

the base is defined with a recess in an outer periphery thereof, a sensor is disposed in the recess and electrically connected to the control circuit board.

2. The foot sensor rubbish bin as claimed in claim 1, wherein a partition plate is disposed between the base and the outer barrel and defines a chamber in the base, the drive assembly is received in the chamber of the base.

3. The foot sensor rubbish bin as claimed in claim 1, wherein the partition plate is defined with a through hole, the linkage push rod extends into the outer barrel through the through hole.

4. The foot sensor rubbish bin as claimed in claim 1, wherein the drive assembly further includes a slide rail, a teeth bar and a gear box, the teeth bar is slidably disposed on the slide rail, the gear box is disposed adjacent to the slide rail and interiorly provided with the gear cluster, the teeth bar is meshed with the gear cluster, the gear box is electrically connected to the motor, the motor drives gears of the gear cluster in such a manner that when the gears of the gear cluster rotate, the teeth bar will slide along the slide rail.

5. The foot sensor rubbish bin as claimed in claim 1, wherein the slide rail is provided with a limit switch on each of two opposite ends thereof, the respective limit switches are electrically connected to the power supply device.

6. The foot sensor rubbish bin as claimed in claim 1, wherein the linkage push rod includes a swing arm and a push rod pivoted to the swing arm, the swing ram has one end pivoted to the teeth bar of the drive assembly and the other end pivoted to the push rod, the push rod is provided with a push spring on one end thereof adjacent to the upper lid.

7. The foot sensor rubbish bin as claimed in claim 3, wherein the partition plate is provided with a clamping member adjacent to the through hole, and the linkage push rod penetrates the through hole while being limited by the clamping member.

8. The foot sensor rubbish bin as claimed in claim 1, wherein the power supply device is received in the base.

9. The foot sensor rubbish bin as claimed in claim 1, wherein the power supply device is disposed at an outer side of the base.

10. The foot sensor rubbish bin as claimed in claim 1, wherein the power supply device holds a battery pack.

11. The foot sensor rubbish bin as claimed in claim 9, wherein the power supply device is further provided with a cover and a power switch for controlling power supply.

* * * * *